United States Patent [19]

Freeman et al.

[11] 4,086,022

[45] Apr. 25, 1978

[54] GAS TURBINE ENGINE WITH IMPROVED COMPRESSOR CASING FOR PERMITTING HIGHER AIR FLOW AND PRESSURE RATIOS BEFORE SURGE

[75] Inventors: Christopher Freeman, Farnsfield; Robert Rudolph Moritz, Littleover, both of England

[73] Assignee: Rolls-Royce Limited, London, England

[21] Appl. No.: 720,656

[22] Filed: Sep. 7, 1976

[30] Foreign Application Priority Data

Sep. 25, 1975 United Kingdom ..... 39260/75

[51] Int. Cl.[2] ..... F01D 5/26; F01D 25/04; F04D 29/68

[52] U.S. Cl. ..... 415/119; 415/144; 415/DIG. 1

[58] Field of Search ..... 415/119, 219 R, DIG. 1, 415/144, 172 A, 168, 181; 60/269; 137/15.1, 15.2

[56] References Cited

U.S. PATENT DOCUMENTS

| | | | |
|---|---|---|---|
| 3,620,640 | 11/1971 | Lariviere | 415/DIG. 1 X |
| 3,893,782 | 7/1975 | Pierpoline et al. | 415/119 |
| 3,934,410 | 1/1976 | Williams | 415/DIG. 1 X |

*Primary Examiner*—Carlton R. Croyle
*Assistant Examiner*—Donald S. Holland
*Attorney, Agent, or Firm*—Cushman, Darby & Cushman

[57] ABSTRACT

A plurality of skewed slots of a particular shape are provided within a compressor casing adjacent at least one stage of compressor blade tips, the slots having an axial length greater than that of the adjacent blade tips. The slots are provided such that upon occurrence of compressor surge or stall, the stagnating air occurring about the blade row may be directed by the slots downstream of the compressor blade row back into the main stream of fluid passing through the compressor. By such an arrangement, the slots provide a compressor in which the air flow and pressure ratio may be increased before reaching compressor stall or surge.

2 Claims, 4 Drawing Figures

FIG. 1.
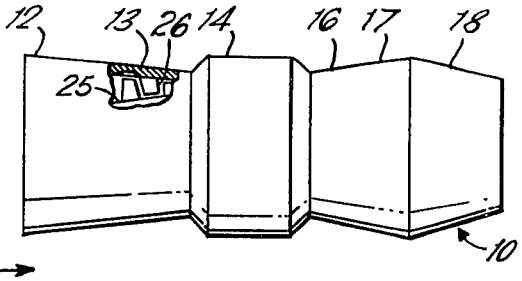
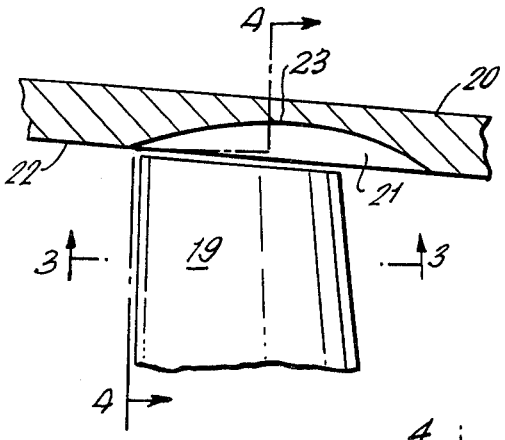
FIG. 2.
FIG. 3.
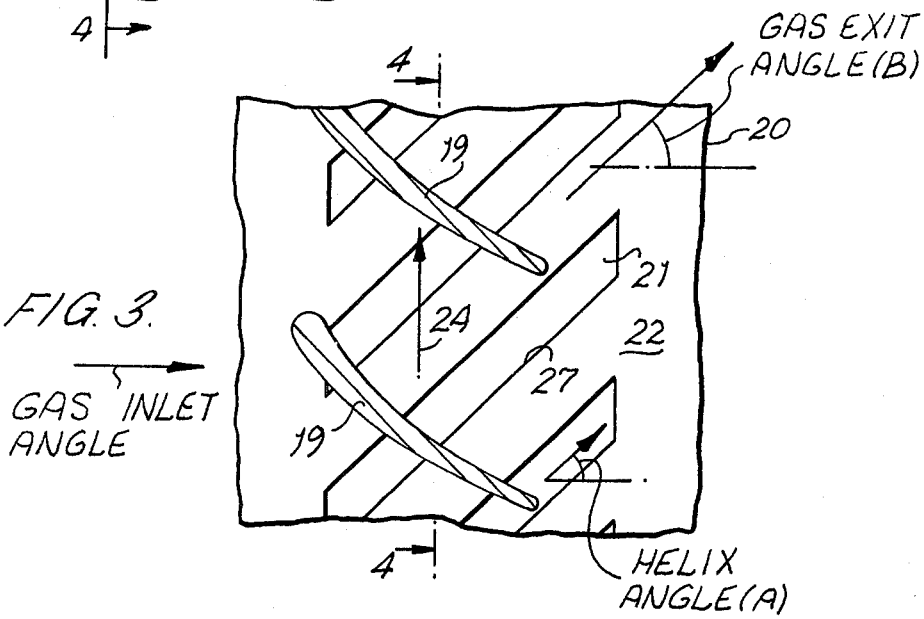

GAS TURBINE ENGINE WITH IMPROVED COMPRESSOR CASING FOR PERMITTING HIGHER AIR FLOW AND PRESSURE RATIOS BEFORE SURGE

This invention relates to gas turbine engines and more particularly to an improved compressor casing for such engines.

BACKGROUND OF THE INVENTION

It has been known to use both centrifugal and axial flow compressors in the past, however most present gas turbine engines are provided with axial flow compressors. While it is well known that centrifugal compressors are more robust, and more easily manufactured than axial flow compressors, axial flow compressors have the ability to consume far more air than a centrifugal compressor having the same frontal area. The axial flow compressor can also be designed for higher pressure ratios than the centrifugal compressor. Since the airflow is an important factor determining the amount of thrust a gas turbine engine produces, this means the axial flow compressor will give more thrust than the centrifugal compressor for the same frontal area, hence it is the more obvious choice for present day gas turbine engines.

An axial flow compressor comprises one or more rotor assemblies that carry blades of aerofoil section, the rotors being mounted between bearings. The rotor assemblies are carried within a casting within which are located stator blades. The compressor is a multi-stage unit as the amount of work done (pressure increase) by each stage is small, a stage consists of a row of rotating blades followed by a row of stator blades. The reason for the small pressure increase across each stage is that the rate of diffusion and the deflection angle of the blades must be limited if losses due to air breakaway at the blades, and subsequent blade stall are to be avoided.

The condition known as stall or surge occurs when the smooth flow of air through the compressor is disturbed. Although the two terms "stall" and "surge" are often used synonomously there is a difference which is mainly a matter of degree. A stall may affect only one stage or even a group of stages but a compressor surge generally refers to a complete flow breakdown through the compressor.

The value of airflow and pressure ratio at which a surge occurs is termed the "surge point". A compressor must obviously be designed to have a safety margin between the airflow and compression ratio at which it will normally be operated and the airflow and compression ratio at which a surge will occur.

BRIEF SUMMARY OF THE INVENTION

The object of the present invention is to provide an axial flow compressor having means such that the value of airflow and pressure ratio may be increased before the compressor "surge point" is reached thus allowing the compressor to be operated at higher airflow and pressure ratios.

Accordingly the present invention provides a casing suitable for an axial flow compressor, the casing having a rotor mounted therein carrying at least one blade row, the casing having at least one circumferential row of slots inclined to the axis of rotation of the blade row and disposed within its internal cylindrical surface adjacent to the at least one blade row, the slots having an axial length substantially greater than that of the blade row, the slots terminating downstream of the blade row.

Preferably the bottom surface of each inclined slot is of a concave shape of substantially aerodynamic form such that high pressure fluid may enter it adjacent the blade row and be ducted along the slot to a location downstream of the at least one blade row.

Additionally each inclined slot is disposed such that its side walls are arranged at an angle to a radial line through the centre of the casing and so extend non-radially into the internal cylindrical surface of the casing with respect of the rotor axis, and the angle of inclination of the slots may be substantially the same angle as that of the exit gas angle of the fluid leaving the at least one blade row.

The invention also comprises a gas turbine engine having a high pressure compressor having an axial flow compressor casing as set forth.

BRIEF DESCRIPTION OF THE DRAWINGS

The invention will now be more particularly described by way of example only and with reference to the accompanying drawings in which:

FIG. 1 shows a pictorial side elevation of a gas turbine engine having a broken away compressor casing portion disclosing a diagrammatic embodiment of the present invention.

FIG. 2 shows an enlarged cross-sectional view in greater detail of the diagrammatic embodiment shown at FIG. 1.

FIG. 3 shows a cross-sectional view taken substantially on the line 3—3 of FIG. 2.

DETAILED DESCRIPTION OF THE INVENTION

Figure 4:
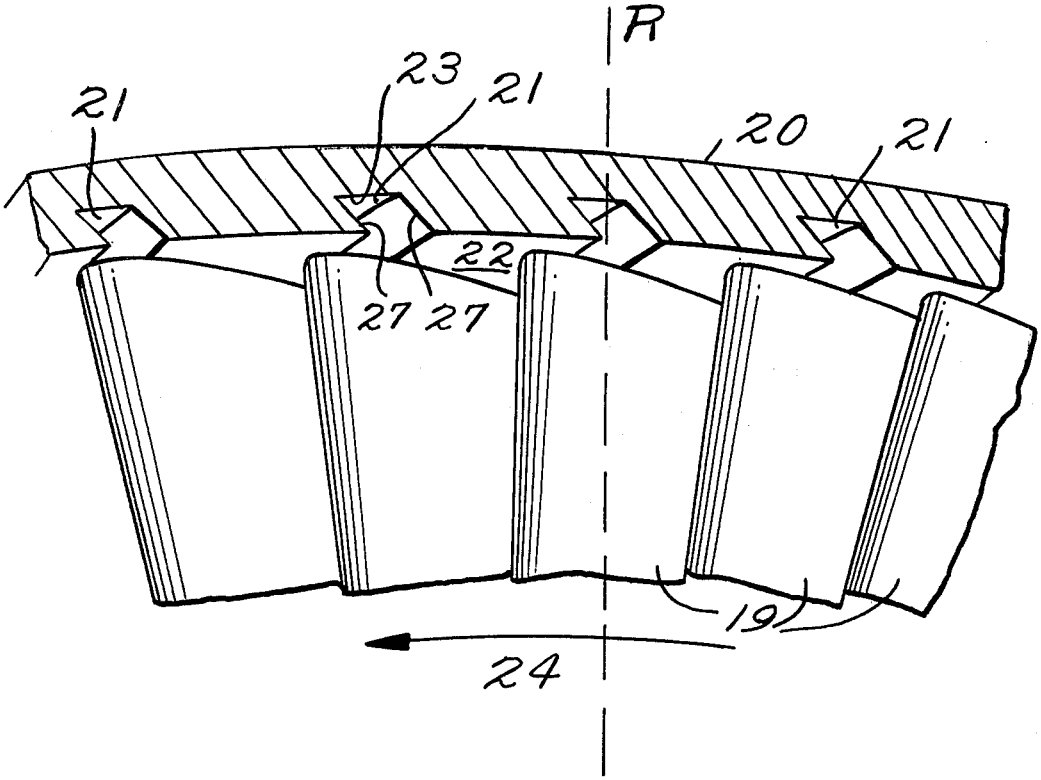
FIG. 4 shows a cross-sectional view taken on line 4—4 of FIG. 2 or 4—4 of FIG. 3.

Referring to FIG. 1 of the drawings, a gas turbine engine shown generally at 10 comprises in flow series a low pressure compressor 12, a high pressure compressor 13, combustion equipment 14, a high pressure turbine 16, a low pressure turbine 17, the engine terminating in an exhaust nozzle 18. The low pressure compressor 12 and low pressure turbine 17, and high pressure compressor 13 and high pressure turbine 16 are each rotatably mounted upon a coaxially arranged shaft assembly not shown in the drawings. A diagrammatic view of an embodiment of the present invention is shown within the broken portion of the high pressure compressor casing 13.

FIG. 2 of the drawings shows a cross-sectional view in greater detail of that shown diagrammatically at FIG. 1 and comprises a portion of a high pressure compressor blade 19 on one stage of a rotor 25 the high pressure compressor 13. A compressor casing is arranged radially outwardly of the high pressure compressor 13, a portion of which is shown at 20. A circumferentially extending array of inclined slots, one of which is shown at 21, are provided within the internal cylindrical surface 22 of the compressor casing 20. The slots 21 have an axial length greater than that of the adjacent high pressure compressor blades 19 such that they terminate downstream of the blades 19. As best shown in FIG. 3, the helix angle (A) of the inclined slots 21 is arranged to be substantially the same as that of the gas outlet or exit angle (B) of the high pressure compressor blades 19. The gas outlet angle being that angle at which the compressed gas leaves the row of compressor blades 19, this angle usually being substantially 45°. This angle is obviously also the same angle as that of the gas inlet angle of the adjacent downstream stator blade row 26. As wil be seen from FIG. 2 of the drawings the bottom surface or wall 23 of the slots 21 is of a concave aerodynamic shape such as to provide a substantially smooth uninterrupted flow path for the passage of gas therethrough.

FIG. 4 of the drawings shows a cross-sectional view taken on line 4—4 of FIG. 2 or FIG. 3 and shows the non-radial disposition of side walls 27 of slots 21 to a radius (R) of the casing 20, the radius (R) extending through the axis of rotation of the rotor 25. The non-radial inclination of the side walls 27 of the slots 21 are arranged such as to collect pressurised gas from the high pressure compressor blades 19. The direction of travel of the high pressure compressor blades being indicated by arrow 24.

For satisfactory operation of a compressor stage such as that shown at 19, it is well known that it, and also its adjacent stages of blades, (not shown in the drawings) must be carefully matched as each stage possesses its own individual airflow characteristics. Thus it is extremely difficult to design a compressor to operate satisfactorily over a wide range of operating conditions such as an aircraft engine encounters.

Outside the design conditions the gas flow around the blade tends to degenerate into a violent turbulence and the smooth pattern of flow through the stage or stages is destroyed. The gas flow through the compressor usually deterioriates and the stalled gas becomes a rapidly rotating annulus of pressurised gas about the tips of one compressor blade stage or group of stages. If a complete breakdown of flow occurs through all the stages of the compressor such that all the stages of blades become "stalled" the compressor will "surge".

The transition from a "stall" to a "surge" can be so rapid as to be unnoticed or on the other hand a stall may be so weak as to produce only slight vibration or poor acceleration or deceleration characteristics. A more severe compressor stall is indicated by a rise in turbine gas temperature, and vibration or coughing of the compressor. A surge is evident by a bang of varying severity from the engine compressor and a rise in turbine gas temperature.

It has been found that the slots 21 provided within the high pressure casing 20 can provide a degree of control or in fact eliminate a "stall" and thus substantially reduce the likelihood of a "surge" occurring.

During operation of the high pressure compressor 13 if the stage of blades 19 is operated outside its design conditions a small surge will begin to occur and a rotating annulus of pressurised gas will begin to build up about the tips of the blades 19, however by virtue of both the helical inclination and tangential disposition of the slots 21 the annulus of air will be directed into the slots and subsequently be exhausted from them downstream of the rotor stage back into the main gas stream flowing through the compressor thus reducing or eliminating the "surge".

When the blades 19 are operating in the "unstalled" condition a portion of the main gas flow through the compressor can run down the slots 21 provided with the compressor casing 20 thus generating a longitudinal vortex through the compressor which is not considered to be greatly detrimental to the compressor's operating efficiency.

We claim:

1. An axial flow compressor for a gas turbine engine comprising:

a rotor having at least one blade row with an axis of rotation;

a compressor casing having an internal cylindrical surface surrounding said at least one blade row, said compressor casing having at least one circumferential row of slots, each of said slots having side walls, a bottom wall and a helical angle of inclination to the axis of rotation of said at least one blade row, said slots being disposed within the internal cylindrical surface of said casing adjacent to said at least one blade row and said slots having an axial length substantially greater than that of said at least one blade row and terminating downstream of said at least one blade row, said helical angle of inclination of each of said slots to the axis of rotation of said at least one blade row being substantially the same angle as an exit angle of fluid leaving said at least one blade row, and said bottom wall of each of said slots having a concave shape which is of substantially aerodynamic form so that high pressure fluid entering each slot adjacent said blade row is ducted along said slot to a location downstream of said at least one blade row and directed back into a main stream of fluid passing through the compressor.

2. An axial flow compressor as claimed in claim 1 in which said side walls of each of said slots extend from said internal cylindrical surface of said casing at an angle to a radius of said casing extending through the axis of rotation of said rotor.

* * * * *